US012584677B2

(12) United States Patent
Rau et al.

(10) Patent No.: US 12,584,677 B2
(45) Date of Patent: Mar. 24, 2026

(54) REFRIGERATION SYSTEM STATOR MOUNT

(71) Applicant: Carrier Corporation, Palm Beach Gardens, FL (US)

(72) Inventors: Mark Rau, Fairport, NY (US); Peter Bushnell, Cazenovia, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 264 days.

(21) Appl. No.: 18/343,161

(22) Filed: Jun. 28, 2023

(65) Prior Publication Data

US 2024/0003611 A1 Jan. 4, 2024

Related U.S. Application Data

(60) Provisional application No. 63/357,738, filed on Jul. 1, 2022.

(51) Int. Cl.

| | |
|---|---|
| ***F25D 19/00*** | (2006.01) |
| ***F25D 11/00*** | (2006.01) |
| ***F25D 17/06*** | (2006.01) |

(52) U.S. Cl.

CPC ..... *F25D 19/00* (2013.01); *F25D 11/003* (2013.01); *F25D 17/067* (2013.01)

(58) Field of Classification Search

CPC ..... F25D 19/00; F25D 11/003; F25D 17/067; F25D 2317/0681; B60H 1/3232; B60H 1/3229; B60H 1/3227; F04D 29/522; F04D 29/601; F04D 29/646

See application file for complete search history.

(56) References Cited

U.S. PATENT DOCUMENTS

| | | | | |
|---|---|---|---|---|
| 4,424,684 | A * | 1/1984 | King et al. | F25D 19/003 62/239 |
| 5,916,253 | A * | 6/1999 | Amr et al. | B60H 1/3232 62/259.1 |
| 10,711,803 | B2 * | 7/2020 | Kiuchi | F04D 17/16 |
| 2011/0011115 | A1 * | 1/2011 | Bushnell | F25D 17/06 62/507 |
| 2018/0283769 | A1 * | 10/2018 | Wikus et al. | F25D 23/06 |
| 2019/0360499 | A1 * | 11/2019 | Au et al. | F04D 29/646 |
| 2020/0238791 | A1 * | 7/2020 | Senf et al. | B60H 1/00014 |

(Continued)

OTHER PUBLICATIONS

Extended European Search Report for European Application No. 23182733.8; Report Mail Date Dec. 7, 2023; 10 Pages.

*Primary Examiner* — Jerry-Daryl Fletcher
*Assistant Examiner* — Dario Antonio Deleon
(74) *Attorney, Agent, or Firm* — CANTOR COLBURN LLP

(57) ABSTRACT

A transport refrigeration unit includes a fan and nozzle unit, a heat exchanger coil, and an axial fan having a vertically oriented fan axis. The axial fan is positioned within the fan and nozzle unit to draw air through the heat exchanger coil and discharge the air vertically upwards. A mounting bracket is used to mount the axial fan in the fan and nozzle unit. The mounting bracket includes a main support member having an opposing first surface and second surface and a through hole and at least one sidewall integrally formed with and extending from the second surface. The at least one sidewall has a smooth front surface and a curvature of the front surface facilitates flow towards a fan inlet.

17 Claims, 16 Drawing Sheets

(56) References Cited

U.S. PATENT DOCUMENTS

| | | | | |
|---|---|---|---|---|
| 2023/0272733 | A1* | 8/2023 | Cote et al. | F04D 29/522<br>417/423.1 |
| 2023/0368763 | A1* | 11/2023 | Gossner | F04D 29/646 |

* cited by examiner

REFRIGERATION SYSTEM STATOR MOUNT

CROSS-REFERENCE TO RELATED APPLICATIONS

This application claims the benefit of U.S. Application No. 63/357,738, filed Jul. 1, 2022, the contents of which are incorporated by reference herein in their entirety.

BACKGROUND

Embodiments of the present disclosure relate to refrigeration systems, and more particularly, to a mounting bracket for mounting a fan of a transport refrigeration unit.

Refrigerated trucks, trailers, and containers are commonly used to transport perishable cargo, such as, for example, produce, meat, poultry, fish, dairy, products, cut flowers, pharmaceuticals and other fresh or frozen perishable products. Conventionally, transport refrigeration systems include a transport refrigeration unit having a refrigerant compressor, a condenser with one or more associated condenser fans, an expansion device, and an evaporator with one or more associated evaporator fans, which are connected via appropriate refrigerant lines in a closed loop refrigerant circuit. Air or an air/gas mixture is drawn from the interior volume of the cargo box by means of the evaporator fan(s) associated with the evaporator, passed through the airside of the evaporator in heat exchange relationship with refrigerant whereby the refrigerant absorbs heat from the air, thereby cooling the air. The cooled air is then supplied back to the cargo box.

Although the existing evaporator fan and bracket for mounting the evaporator fan are suitable, these components may be optimized to reduce the inefficiencies in the airflow provided to the fan.

BRIEF DESCRIPTION

According to an embodiment, a transport refrigeration unit includes a fan and nozzle unit, a heat exchanger coil, and an axial fan having a vertically oriented fan axis. The axial fan is positioned within the fan and nozzle unit to draw air through the heat exchanger coil and discharge the air vertically upwards. A mounting bracket is used to mount the axial fan in the fan and nozzle unit. The mounting bracket includes a main support member having an opposing first surface and second surface and a through hole and at least one sidewall integrally formed with and extending from the second surface. The at least one sidewall has a smooth front surface and a curvature of the front surface facilitates flow towards a fan inlet.

In addition to one or more of the features described herein, or as an alternative, in further embodiments a diameter defined by the at least one sidewall gradually increases from adjacent the main support member to a distal end of the at least one sidewall.

In addition to one or more of the features described herein, or as an alternative, in further embodiments the at least one sidewall has a back surface opposite the front surface, the back surface having a configuration complementary to a surface of the fan and nozzle unit.

In addition to one or more of the features described herein, or as an alternative, in further embodiments comprising at least one feature arranged at the back surface, wherein the at least one feature extends between the back surface and the main support member.

In addition to one or more of the features described herein, or as an alternative, in further embodiments the main support member has a front end and a back end, the at least one sidewall extending between the front end and the back end, wherein an axial length of the at least one sidewall varies between the front end and the back end.

In addition to one or more of the features described herein, or as an alternative, in further embodiments the axial length of the at least one sidewall gradually increases from the front end towards the back end.

In addition to one or more of the features described herein, or as an alternative, in further embodiments the at least one sidewall has a bend formed therein such that the at least one sidewall wraps about the back end of the main support member.

In addition to one or more of the features described herein, or as an alternative, in further embodiments the at least one sidewall includes a first sidewall and a second sidewall, the first sidewall and the second sidewall being symmetrical about a central plane.

In addition to one or more of the features described herein, or as an alternative, in further embodiments the main support member has a front end and a back end, the mounting bracket further comprising a front wall extending from the front end at an angle thereto.

In addition to one or more of the features described herein, or as an alternative, in further embodiments the front wall is arranged perpendicular to the main support member.

In addition to one or more of the features described herein, or as an alternative, in further embodiments the front wall further comprises a honeycomb-like pattern is formed at a surface thereof.

In addition to one or more of the features described herein, or as an alternative, in further embodiments comprising at least one feature protruding from a first surface of the main support member, wherein the at least one feature defines at least a portion of a boundary within which the fan is positionable.

In addition to one or more of the features described herein, or as an alternative, in further embodiments comprising at least one mounting member extending from the first surface of the main support member, the at least one mounting member being positionable in overlapping arrangement with a surface of the fan and nozzle unit.

In addition to one or more of the features described herein, or as an alternative, in further embodiments the at least one mounting member has a corner-like configuration.

In addition to one or more of the features described herein, or as an alternative, in further embodiments the mounting bracket is formed from a glass filled composite material.

According to an embodiment, a transport refrigeration unit includes a fan and nozzle unit, a heat exchanger coil, and an axial fan having a vertically oriented fan axis. The axial fan is positioned within the fan and nozzle unit to draw air through the heat exchanger coil and discharge the air vertically upwards. The axial fan comprises a stator assembly including a mounting flange arranged at a first end thereof. A mounting bracket is used to mount the axial fan in the fan and nozzle unit. The mounting bracket includes a main support member having an opposing first surface and second surface and a through hole. The mounting flange is positioned in overlapping arrangement with the first surface. At least one sidewall is integrally formed with and extends from the second surface. The at least one sidewall has a smooth front surface and a curvature of the front surface facilitates flow towards the stator assembly.

In addition to one or more of the features described herein, or as an alternative, in further embodiments the first surface further comprises at least one feature defining a boundary within which the mounting flange is positioned.

In addition to one or more of the features described herein, or as an alternative, in further embodiments a diameter defined by the at least one sidewall gradually increases from adjacent the main support member to a distal end of the at least one sidewall.

In addition to one or more of the features described herein, or as an alternative, in further embodiments the at least one sidewall has a back surface opposite the front surface, the back surface having a configuration complementary to a surface of the fan and nozzle unit.

In addition to one or more of the features described herein, or as an alternative, in further embodiments the mounting bracket is formed from a composite material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
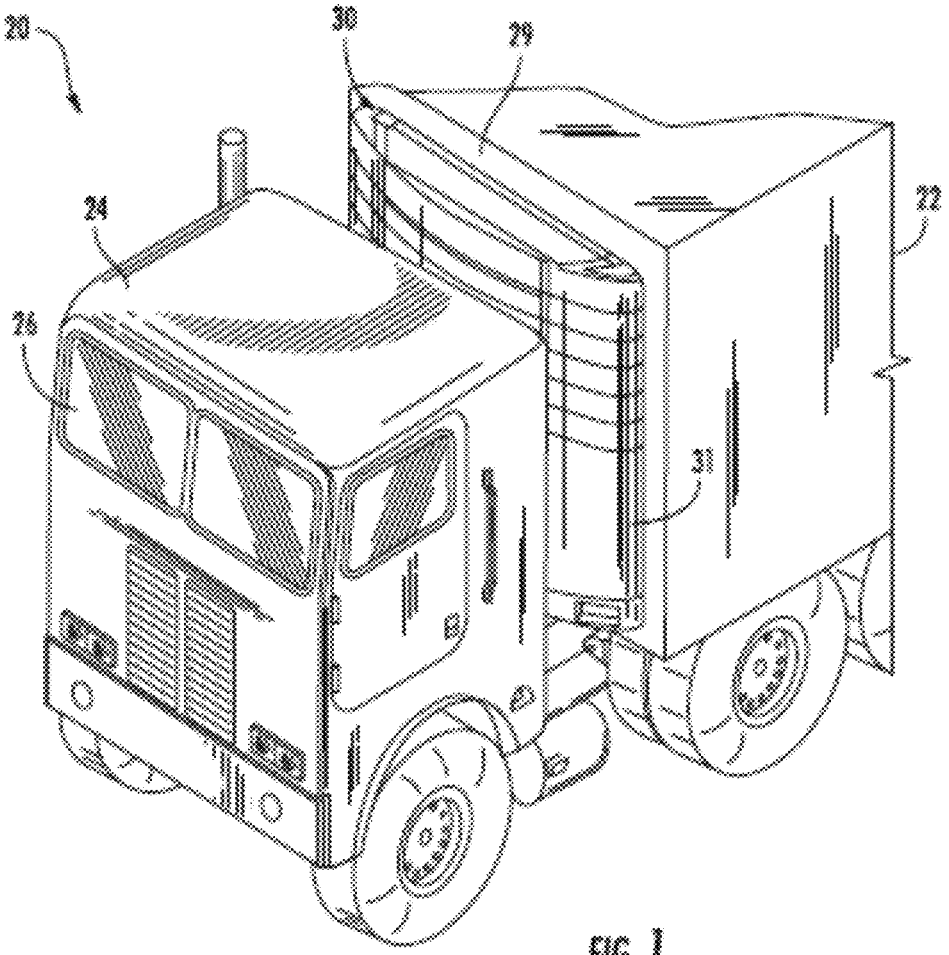
FIG. 1 is a perspective view of an exemplary transport refrigeration system according to an embodiment.

With reference now to FIG. 1, an exemplary transport refrigeration system 20 is illustrated. In the illustrated, non-limiting embodiment, the transport refrigeration system 20 is shown as a trailer system. As shown, the transport refrigeration system 20 includes a cargo container or trailer 22. The cargo container 22 may be towed or otherwise transported by a tractor 24 including an operator's compartment or cab 26 an engine or other power source, such as a fuel cell for example, which acts as the drivetrain system of the tractor 24. A transport refrigeration unit (TRU) 30 is configured to maintain cargo located within the internal cargo area 28 (see FIG. 3) of the container 22 at a selected temperature by cooling the cargo space of the container 22. As shown, the TRU 30 is typically mounted at the front wall 29 of the container 22. Together, the TRU 30 and the cargo container 22 may form a transport refrigeration system 20. However, embodiments where the transport refrigeration system 20 is additionally interpreted to include the tractor 24 are also contemplated herein. Further, it should be appreciated by those of skill in the art that embodiments described herein may be applied to any transport refrigeration system such as, for example shipping containers that are shipped by rail, sea (via a watercraft), or any other suitable container, without use of a tractor 24.

Figure 2:
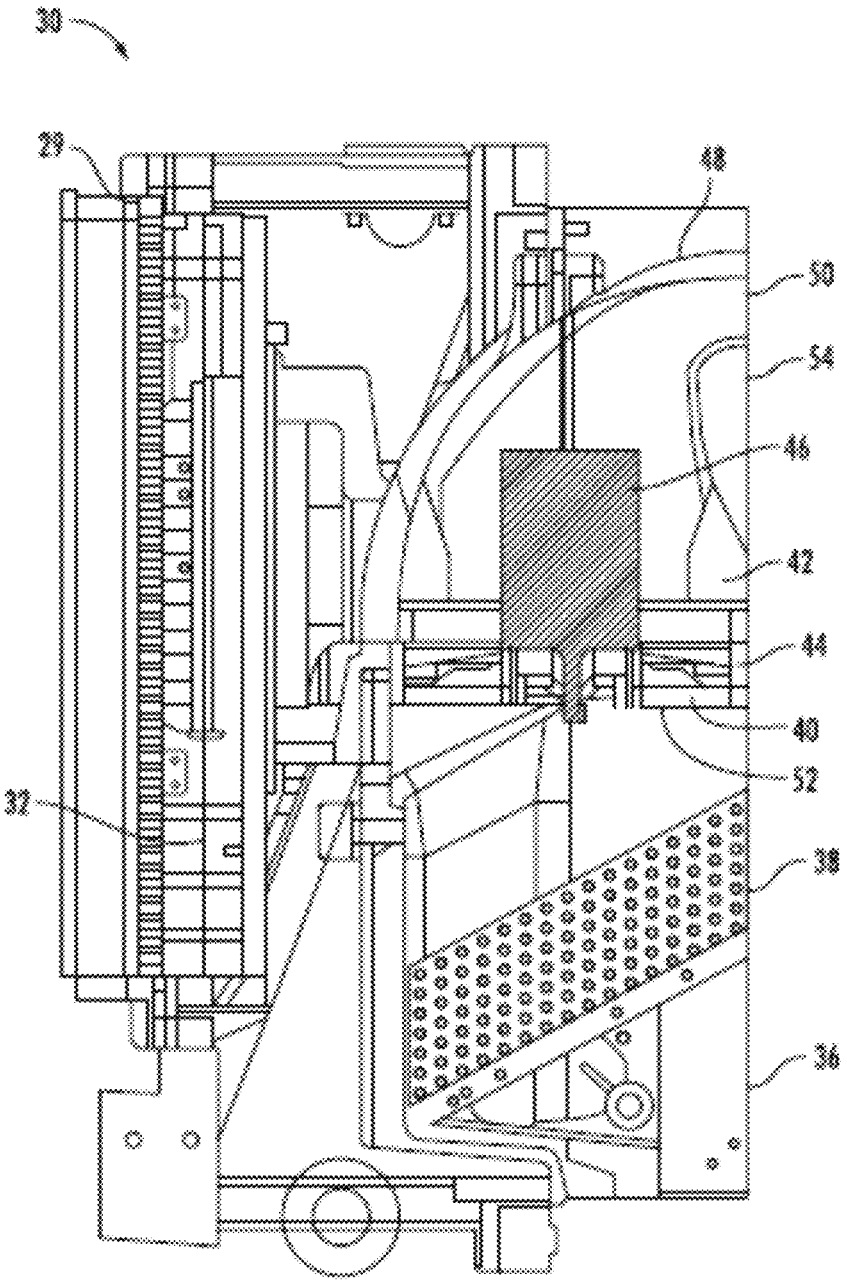
FIG. 2 is a cross-sectional view of the transport refrigeration unit of FIG. 1 according to an embodiment.
Figure 3:
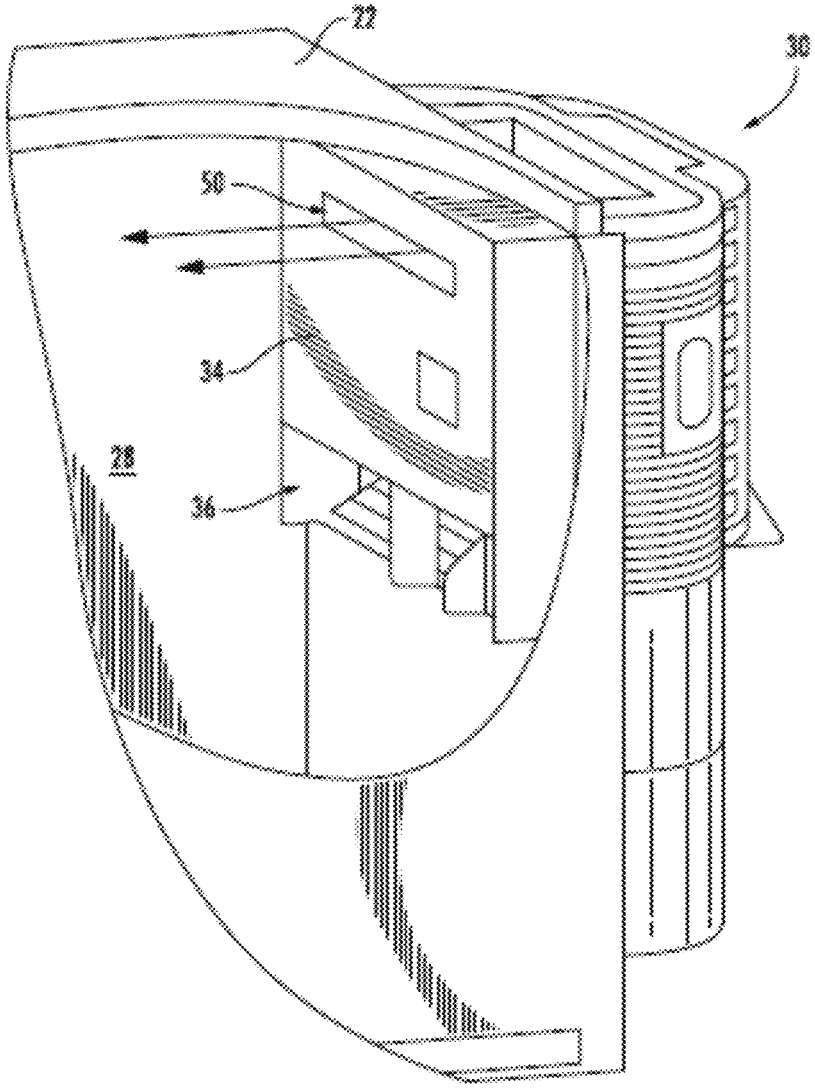
FIG. 3 is a perspective view of a transport refrigeration unit from an interior of a cargo container according to an embodiment.
Figure 4:
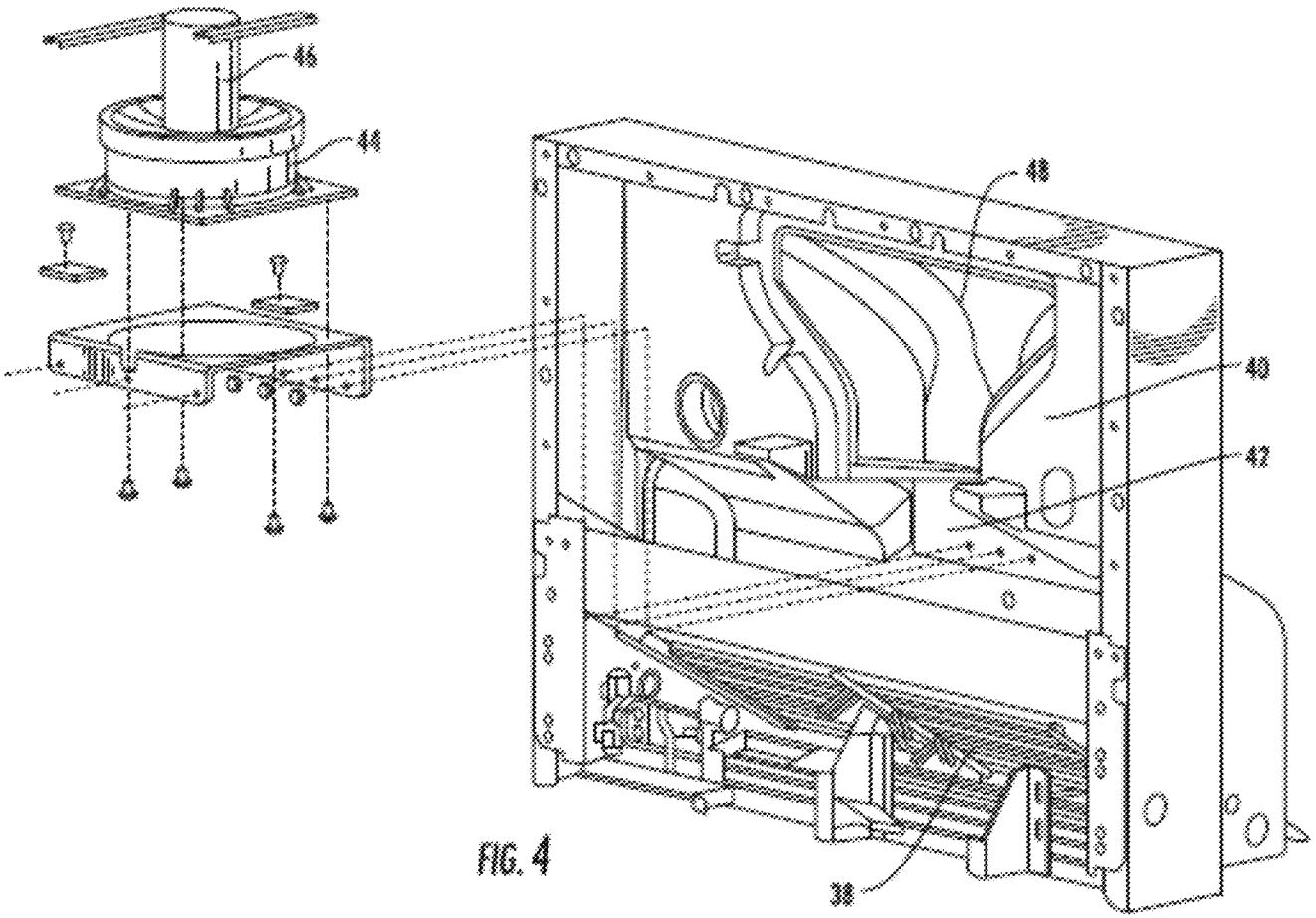
FIG. 4 is a partially exploded view of a fan assembly and a fan and nozzle unit of a transport refrigeration unit according to an embodiment.
Figure 5:
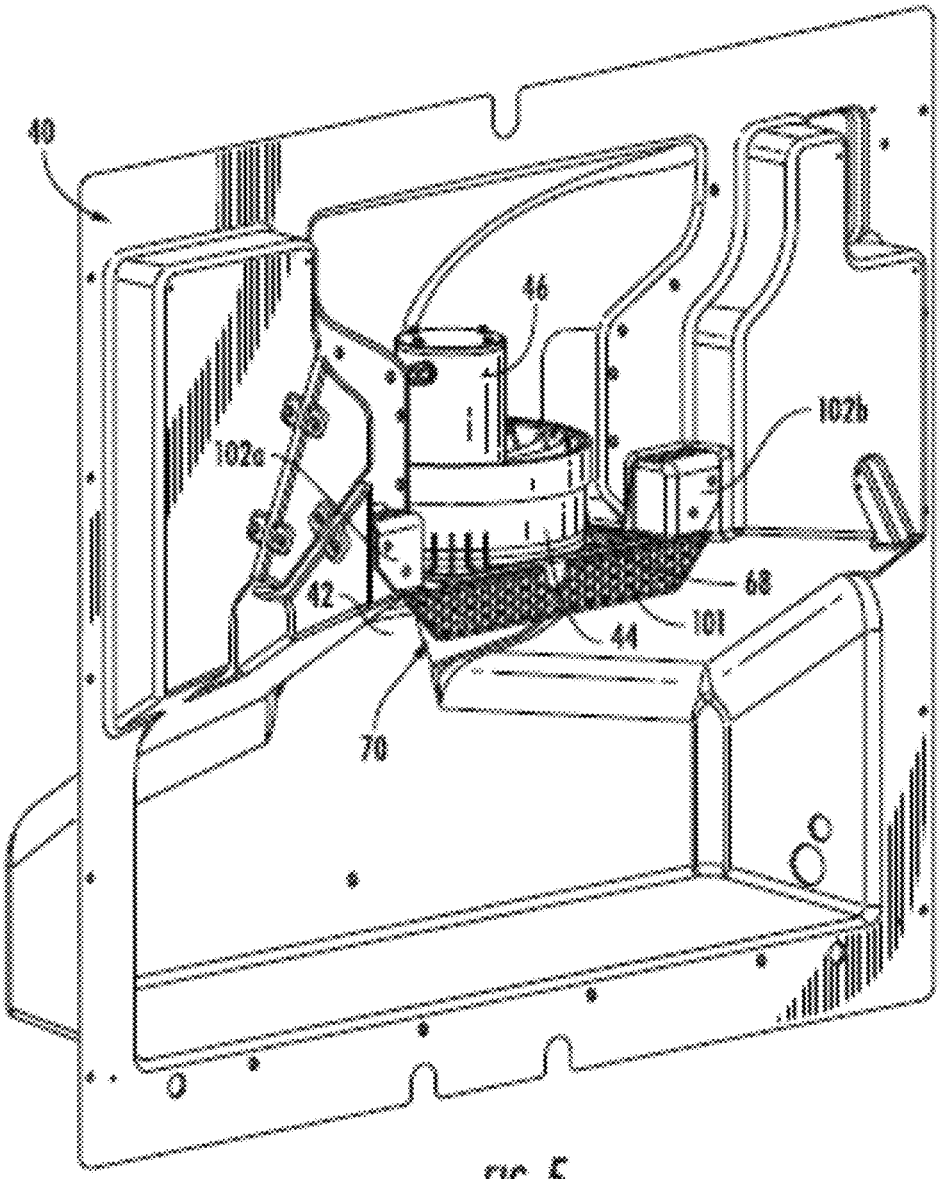
FIG. 5 is a perspective view of fan and nozzle unit having an exemplary mounting bracket and fan according to an embodiment.
Figure 6:
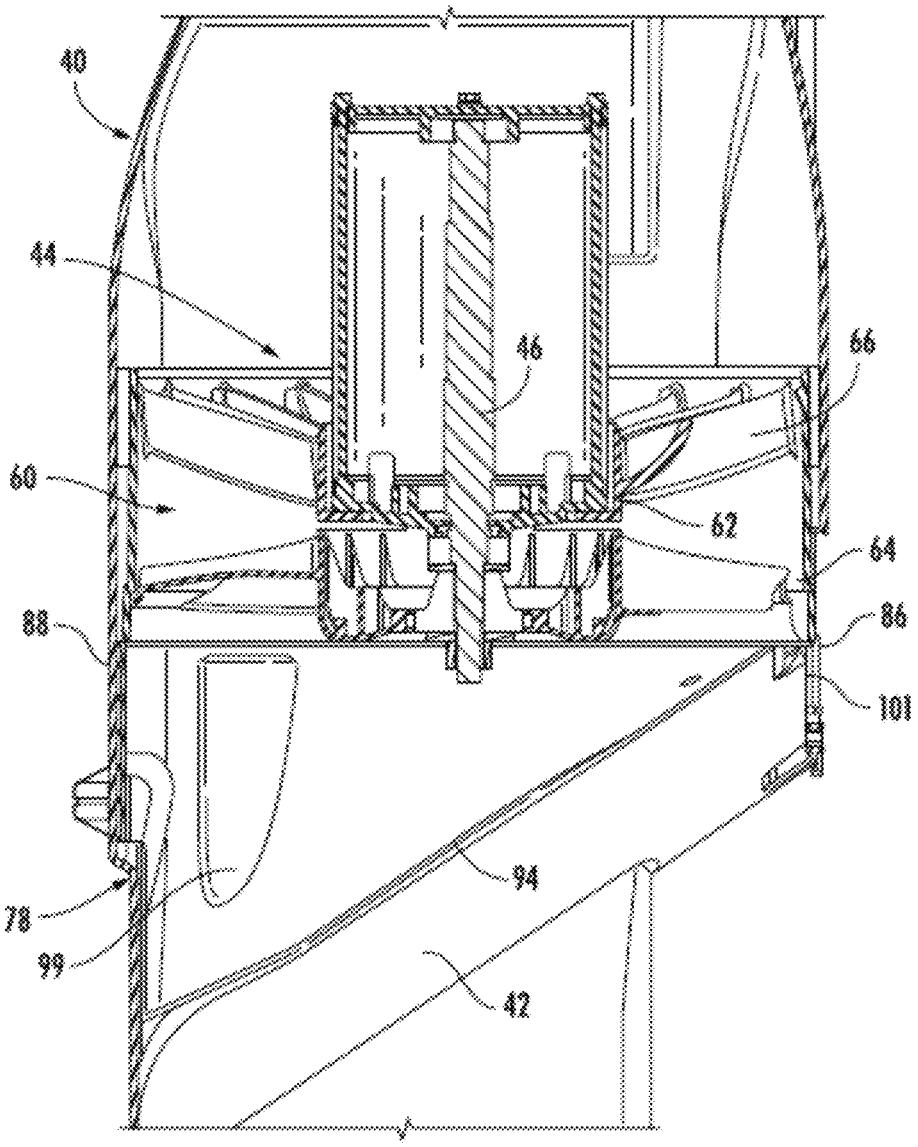
FIG. 6 is a cross-sectional view of the fan and nozzle unit of FIG. 5 according to an embodiment.
Figure 7:
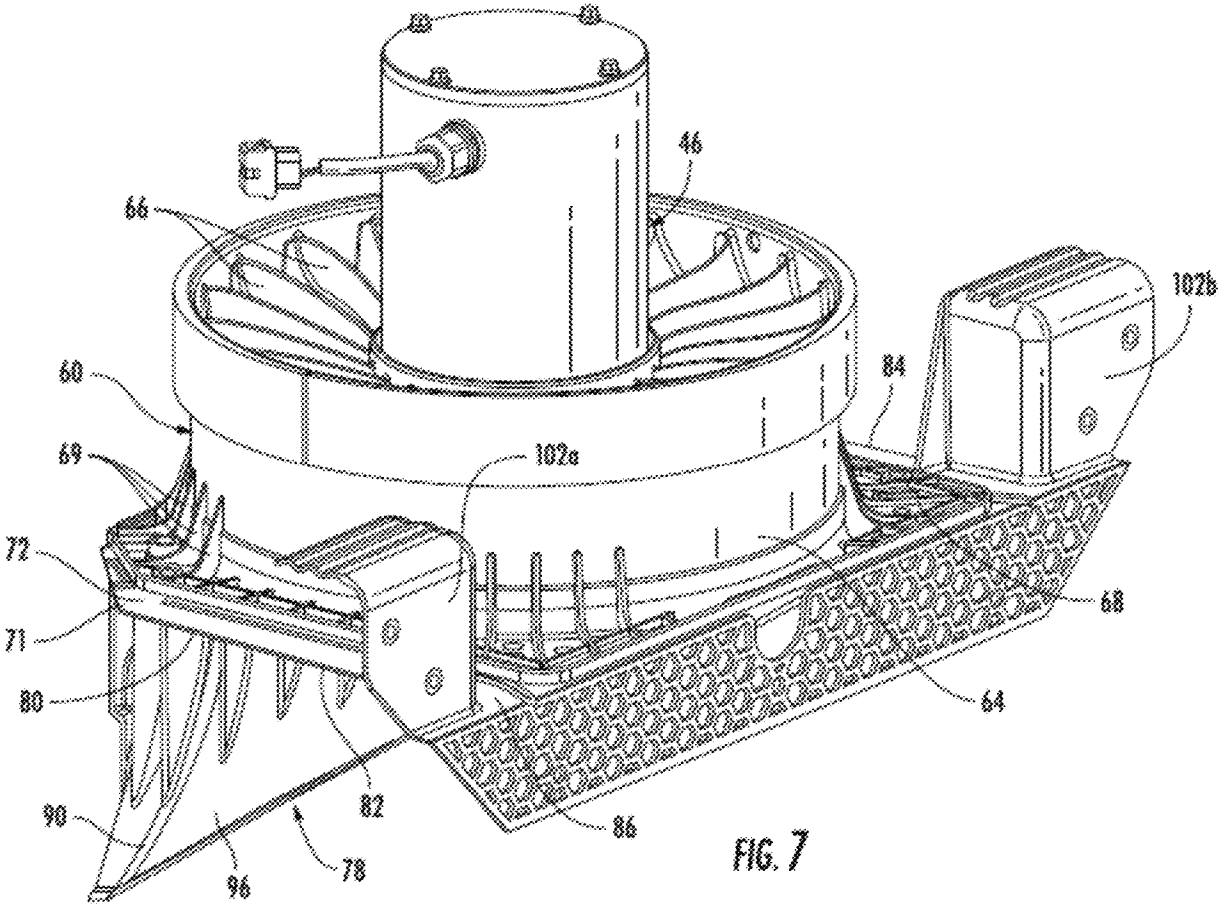
FIG. 7 is a perspective view of an exemplary mounting bracket and fan according to an embodiment.
Figure 8:
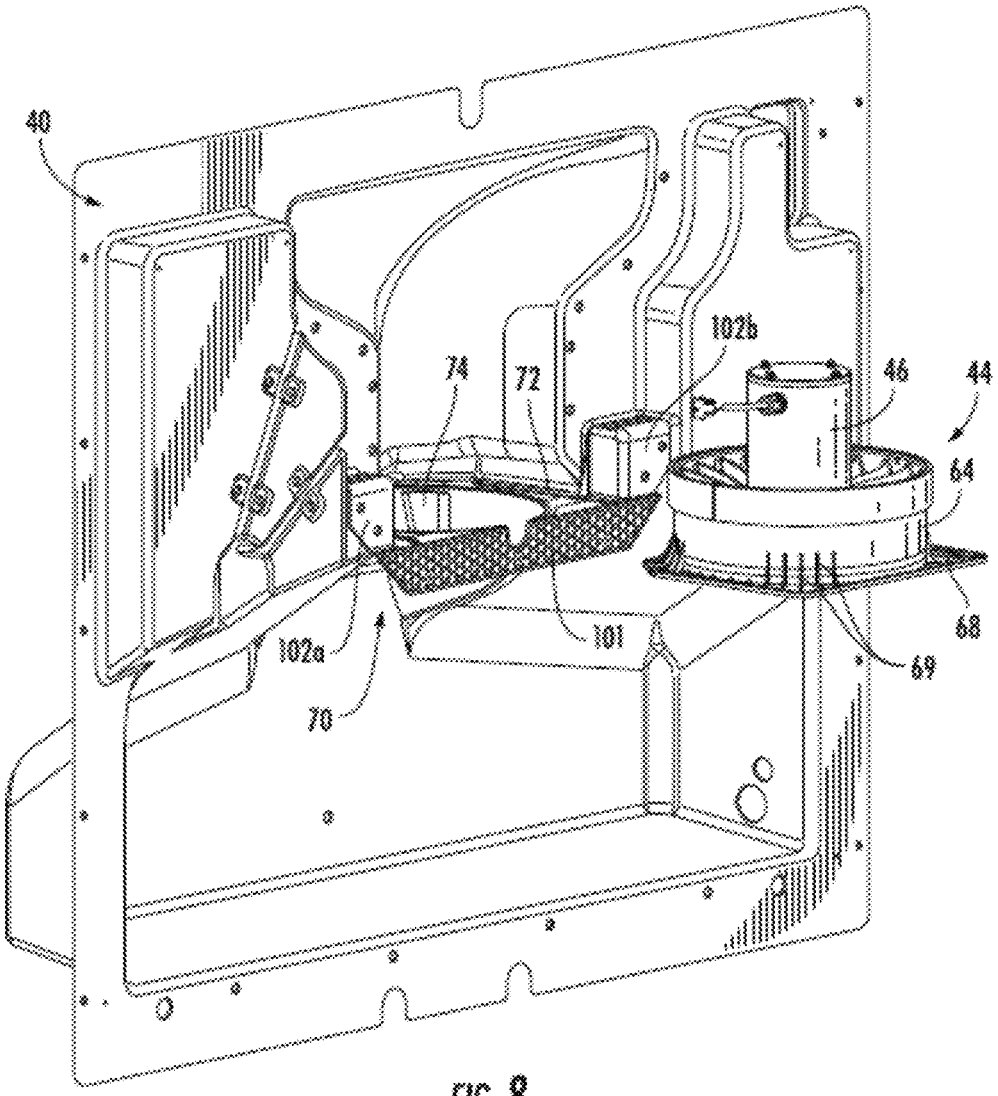
FIG. 8 is a partially exploded view of a fan assembly and a fan and nozzle unit of FIG. 5 according to an embodiment.

As best shown in FIG. 2, the TRU 30 includes an exterior condenser 32 that projects forward of the front wall 29 and an interior evaporator section 34 disposed within the front wall 30 and that projects rearwardly toward the cargo area 28 of the trailer 20. With reference now to FIGS. 3 and 4, an example of an evaporator section 34 of the TRU 30 is illustrated in more detail. The evaporator section 34 includes an inlet 36 that receives return air from the cargo area 28 of the trailer body 22. Mounted within a lower portion of the evaporator section 34 is an evaporator coil 38. The evaporator coil 38 may be mounted at an angle, as shown, to increase the effective surface area and assist in condensate drainage. However, embodiments where the evaporator coil 38 is mounted with a different configuration are also within the scope of the disclosure.

Mounted on a support deck of the evaporator section 34 is a fan and nozzle unit 40 having one or more interior regions. Disposed within an interior region 42 adjacent the bottom of the fan and nozzle unit 40 is an axial flow fan 44 and an electric drive motor 46 positioned vertically above the fan 44. The axes of the fan 44 and the drive motor 46 are vertically oriented. The nozzle 48 of the fan and nozzle unit 40 extends from adjacent the fan 44 to an outlet 50. In the illustrated, non-limiting embodiment, a first end 52 of the nozzle 48, is generally rounded so as to surround the fan 44. Moving from the first end 52 to a second end 54, the nozzle 48 decreases in cross-sectional area and gradually transitions from the circular shape to a wide aspect ratio rectangular cross-section, while also turning approximately 90 degrees to a rearwardly facing outlet 50.

During operation, the return air from the cargo area 28 of the trailer 20 is drawn into the inlet 36, passed through the evaporator coil 38 where the air is cooled, and is then blown out of the outlet 50 toward the rear of the cargo area 28, to cool the cargo. It should be understood that the TRU 30 illustrated and described herein is intended as an example only. Accordingly, other transport refrigeration units having an inlet 36 for receiving air from the cargo area 28 of the container 22 and an outlet 50 for discharging cool air into the cargo area 28 of the container 22 are also within the scope of the disclosure.

With reference now to FIGS. 5-14, the axial flow fan 44 mounted within an interior region 42 of the fan and nozzle unit 40 is illustrated in more detail. As shown, the axial flow fan 44 includes a fan inlet including a stator assembly 60 having a stator hub 62, a stator shroud 64, and a plurality of stator vanes 66 extending radially outwardly from the centrally located stator hub 62 to the stator shroud 64. In an embodiment, the stator assembly 60 includes a mounting flange 68 integrally formed with the stator shroud 64. As shown, the mounting flange 68 is arranged adjacent a first, upstream end of the stator assembly 60 and extends radially outwardly from the stator shroud 64. The mounting flange 68 may extend about an entire periphery of the stator shroud 64, or alternatively, may be arranged at only a portion of the periphery of the stator shroud 64. Furthermore, radial length of the mounting flange 68 may vary about the periphery of the stator shroud 64. As a result, the mounting flange 68 may have a non-circular shape. In an embodiment, a plurality of ribs 69 extend between an upper surface of the mounting flange 68 and the outer periphery of the stator shroud 64. Inclusion of such ribs 69 may increase the rigidity or stiffness of the stator assembly 60. The stator assembly 60 may be formed from any suitable material including, but not limited to a metal material and a composite material for example. In an embodiment, the composite material is an injection molded glass filled composite.

A mounting bracket 70 is operable to mount the stator assembly 60 within the interior region 42 of the fan and nozzle unit 40. In an embodiment, the mounting bracket 70 is formed as a unitary component from a composite material, such as an injection molded glass filled composite material. The mounting bracket 70 includes a body having a main support member 71 having a generally planar first surface 72. The mounting flange 68 of the stator assembly 60 may be positionable in overlapping arrangement with the first surface 72 of the mounting bracket 70. Accordingly, a through hole 74 is formed in the main support member 71 in axial alignment with the stator assembly 60. The through hole 74 may be substantially equal in diameter to the interior of the stator shroud 64 such that a uniformly sized fluid flow path is defined therethrough. The first surface 72 of the mounting bracket 70 may be equal to or may be generally larger than mounting flange 68, as shown. In such embodiments, one or more features 76 may protrude from the first surface 72 to facilitate proper positioning of the mounting flange 68 relative to the mounting bracket 70. In the illustrated, non-limiting embodiment, several features 76 extend at various locations generally orthogonally from the first surface 72 to form at least a partial boundary or border surrounding the mounting flange 68.

The body additionally includes at least one sidewall 78 extending from the main support member 71. In the illustrated, non-limiting embodiment, the at least one sidewall 78 is integrally formed with a second, opposite surface 80 of the main support member 71 and extends generally downwardly therefrom. The at least one sidewall 78 may be connected to the surface 80 directly adjacent to the through hole 74 or at another portion of the surface 80. As shown, the at least one sidewall 78 includes two sidewalls: a first sidewall 78 arranged adjacent a first side 82 of the body and a second sidewall 78 arranged adjacent a second opposite side 84 of the body. The first and second sidewalls 78 may be substantially identical to one another, such as mirror images of one another (symmetrical) about a central plane.

In an embodiment, each sidewall 78 extends between a front end 86 of the main support member 71 and a back end 88 of the main support member. An axial length of the sidewall 78 between the front and back ends 86, 88 may be constant, or alternatively, may vary. In the illustrated, non-limiting embodiment, the axial length of the at least one sidewall 78 is shortest near the front end 86 of the main support member 71 and may gradually increase towards the back end 88 of the main support member 71. The at least one sidewall 78 may have an angle or bend 90 formed therein such that the at least one sidewall 78 wraps about a portion of the back end 88. In such embodiments, the axial length of the sidewall 78 may gradually increase from the bend 90 towards the distal end 92 of the sidewall 78. Accordingly, the maximum axial length of the sidewall 78 may be at or near the distal end 92 of the sidewall.

The at least one sidewall 78 has an opposing front surface 94 and back surface 96. In the illustrated, non-limiting embodiment, the back surface 96 of the at least one sidewall 78 is positionable in contact with a corresponding surface within the interior 42 of the fan and nozzle unit 40. To facilitate installation and proper positioning of the body within the fan and nozzle unit 40, the back surface 96 may be substantially complementary to the surface of the fan and nozzle unit 40. With such a complementary configuration, contact between the surface of the fan and nozzle unit and the back surface 46 of the sidewall 78 may be substantially uniform over the back surface 96 of the sidewall 78. In an embodiment, at least one feature 98 extends between the back surface 96 of the sidewall 78 and the main support member 71. Inclusion of these features 98, such as ribs for example, provides added strength and rigidity to the sidewall 78. In embodiments including these features, contact with the fan and nozzle unit 40 may be uniform about the features 98 extending from the back surface 96.

Figure 15:
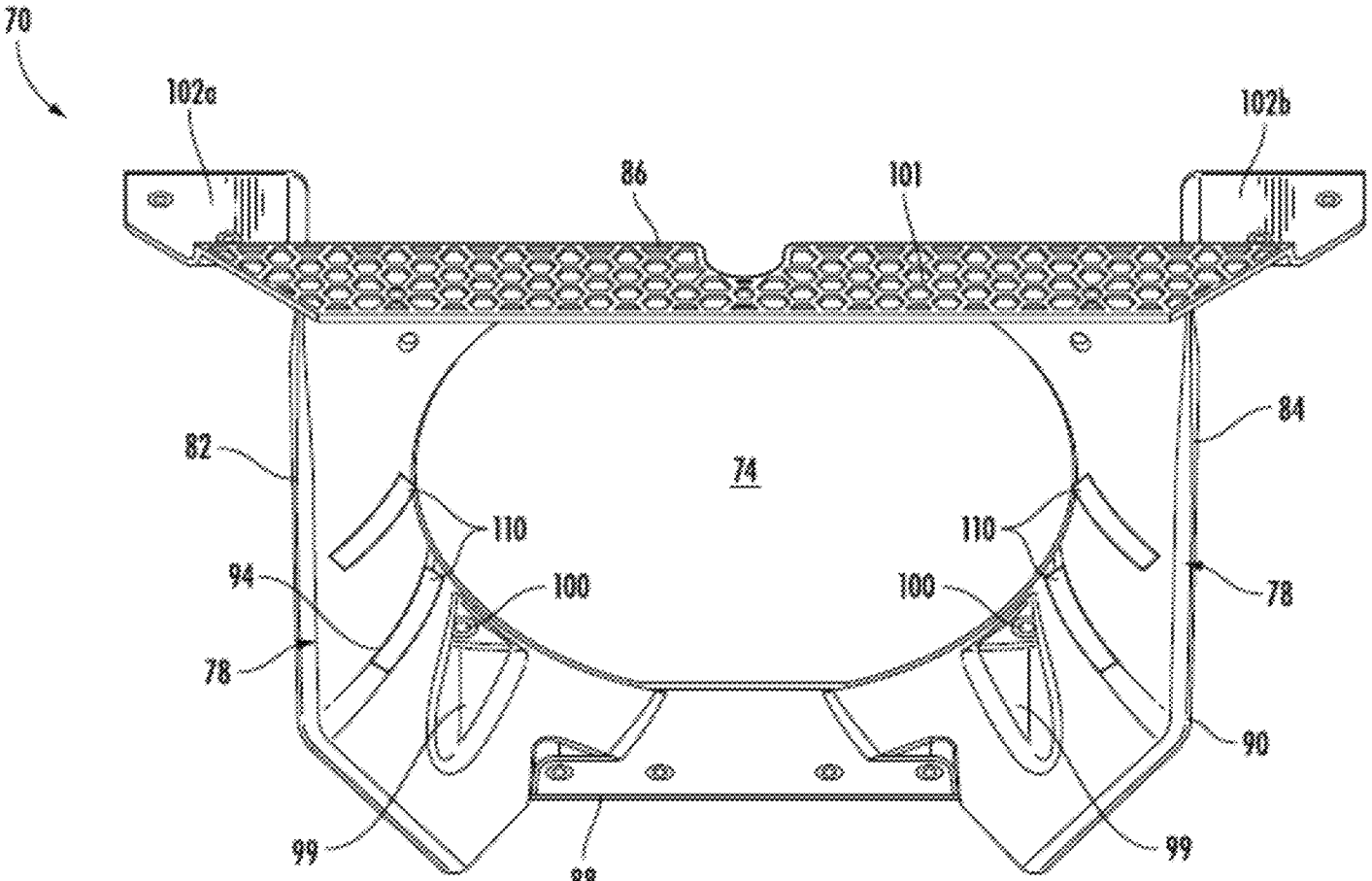
FIG. 15 is a bottom perspective view of the exemplary mounting bracket of FIG. 11 according to an embodiment.

The front surface 94 of the at least one sidewall 78 may be substantially smooth to minimize the formation of any interferences within the fluid flow path leading towards the fan 44. Further, in the illustrated, non-limiting embodiment, the front surface 94 of the sidewall 78 is contoured to direct flow from the evaporator section 34 towards an inlet of the fan 44. As shown, the front surface 94 may be formed with a generally convex curvature that curves outwardly from a position adjacent to the through hole 74, similar to a bell mouth shape. Accordingly, a diameter defined by the plurality of sidewalls 78 gradually increases from the smallest diameter at a position adjacent to the main support member 71 to a maximum diameter defined near the free ends of the sidewalls 78. In an embodiment, shown in FIG. 15, at least one flow feature 110, such as a rib, guide, or flow shaping protrusion extends from the front surface 94 towards a center defined by the at least one sidewall 78. Inclusion of these flow features 100, may assist in directing the flow output from the evaporator coil towards the center of the mounting bracket 70 and the inlet of the axial fan 44.

Figure 16:
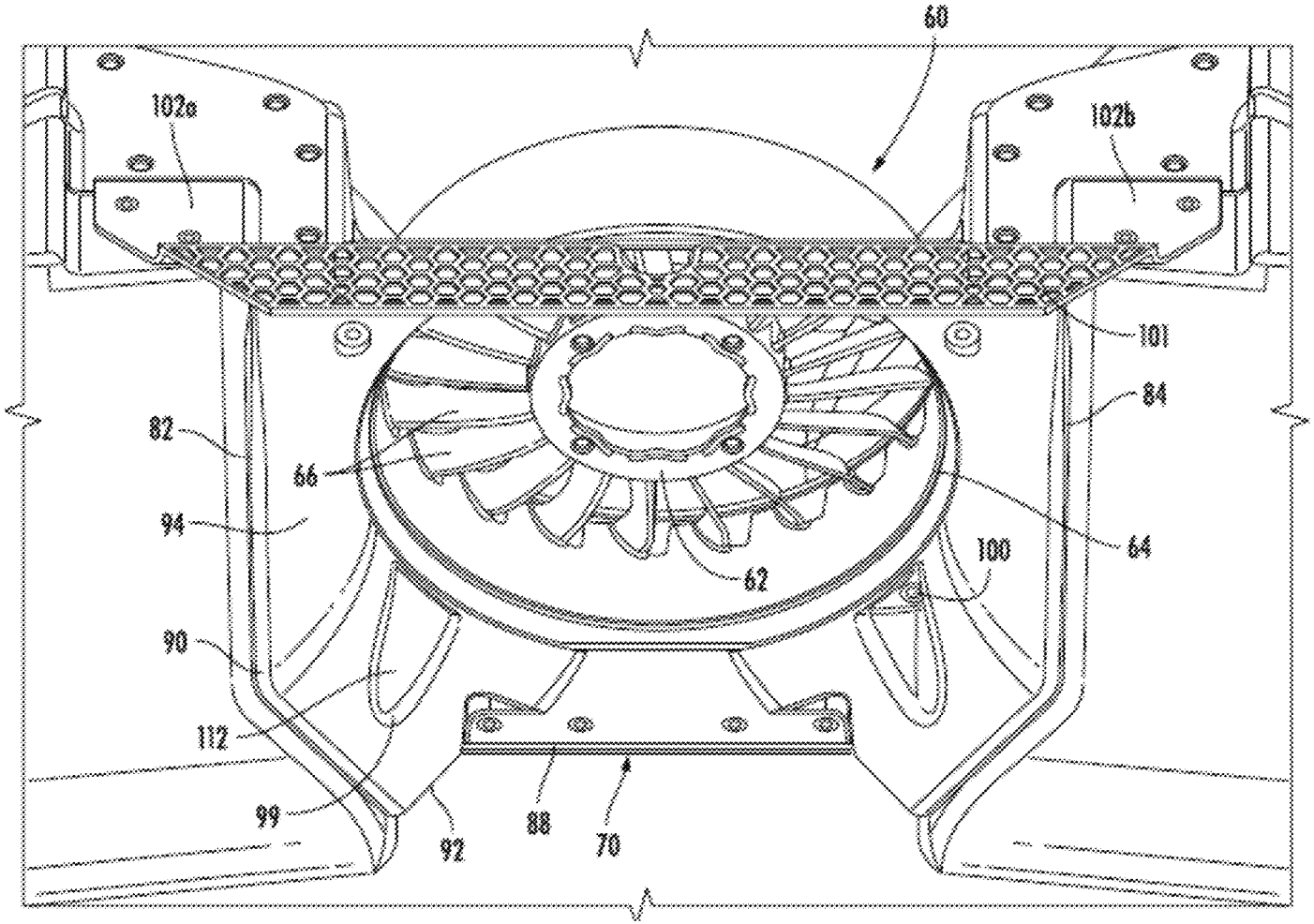
FIG. 16 is a bottom perspective view of an exemplary mounting bracket installed within an interior region of a fan and nozzle unit according to an embodiment.

One or more fasteners 100 may be used to affix the stator assembly 60 to the mounting bracket 70. In an embodiment, one or more cavities 99 may be formed in the front surface 94 of each sidewall 78. In the illustrated, non-limiting embodiment, the cavity 99 provides access to a fastener 100 operable to couple the main support member 71 of the mounting bracket 70 to the mounting flange 68 of the stator assembly 60. However, embodiments that have a continuous surface absent a cavity 99 are also contemplated herein. As shown in FIG. 16, the mounting bracket 70 may include a cover 112 removably positionable in overlapping arrangement with each cavity 99 to form a smooth front surface 94 thereat. For example, the cover 112 may connect to the sidewall 78 via a snap fit or press-fit connection. Alternatively, the cavities 99 may be absent from the sidewalls 78. Further, the front surface 94 may have one or more rivets or openings through which fasteners operable to mount the mounting bracket 70 may be installed.

The body of the mounting flange 78 may include a front wall 101 extending from the front end 86 at an angle relative to the main support member 71. The axial length of the front wall 101 is only a portion of the axial length of the sidewalls. However, embodiments where the axial length of the front wall 101 is extended are also contemplated herein. In the illustrated, non-limiting embodiment, the front wall 101 is oriented substantially parallel to the axis of the fan, and therefore generally perpendicular to the planar surface 72. However, embodiments where the front wall 101 is arranged at another angle are also within the scope of the disclosure. In an embodiment, to increase the rigidity of the structure, a honeycomb-like pattern is formed at a surface of the front wall 101, such as the surface facing away from the mounting bracket 70.

Figure 9:
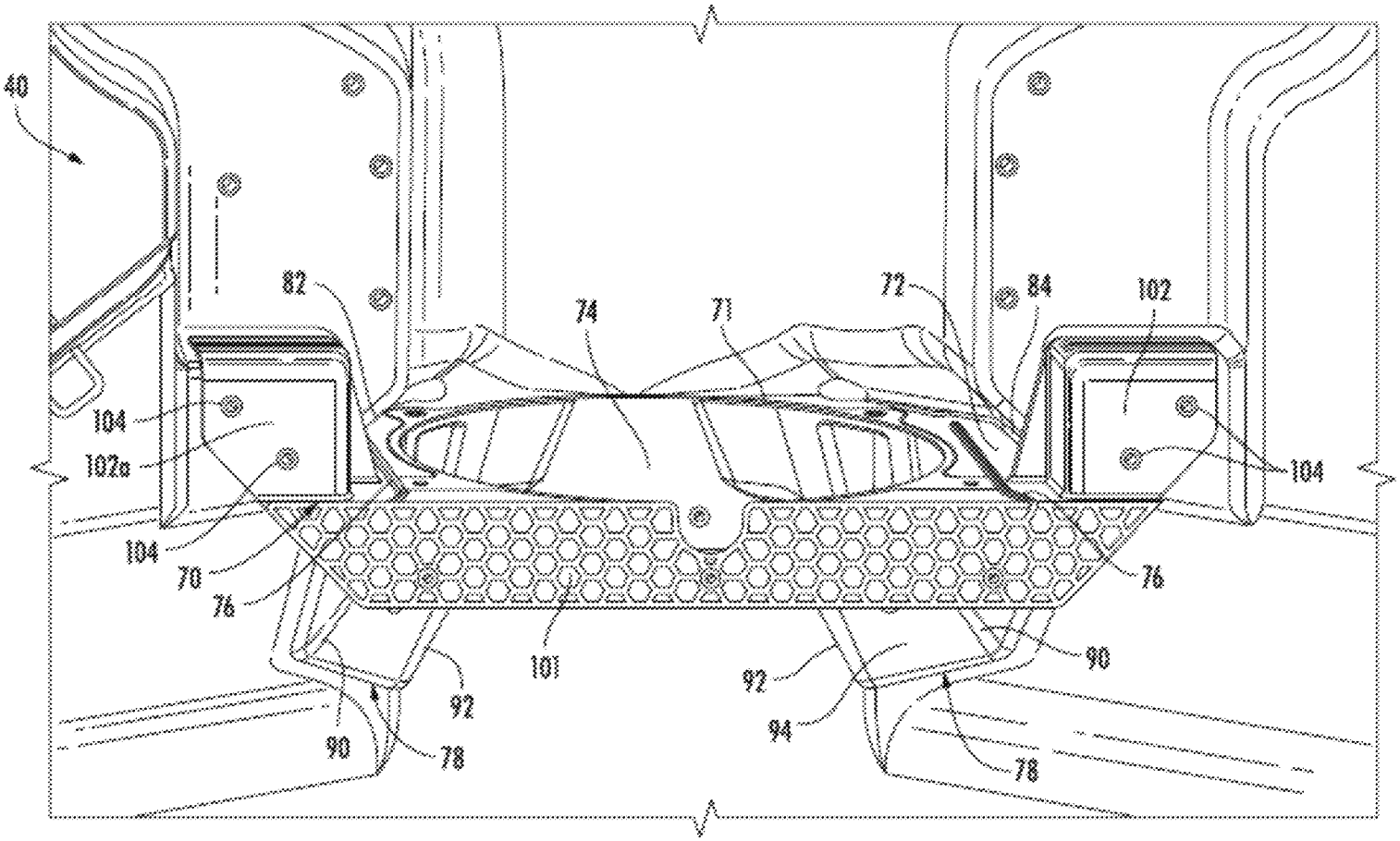
FIG. 9 is a front perspective view of an exemplary mounting bracket installed within an interior region of a fan and nozzle unit according to an embodiment.
Figure 10:
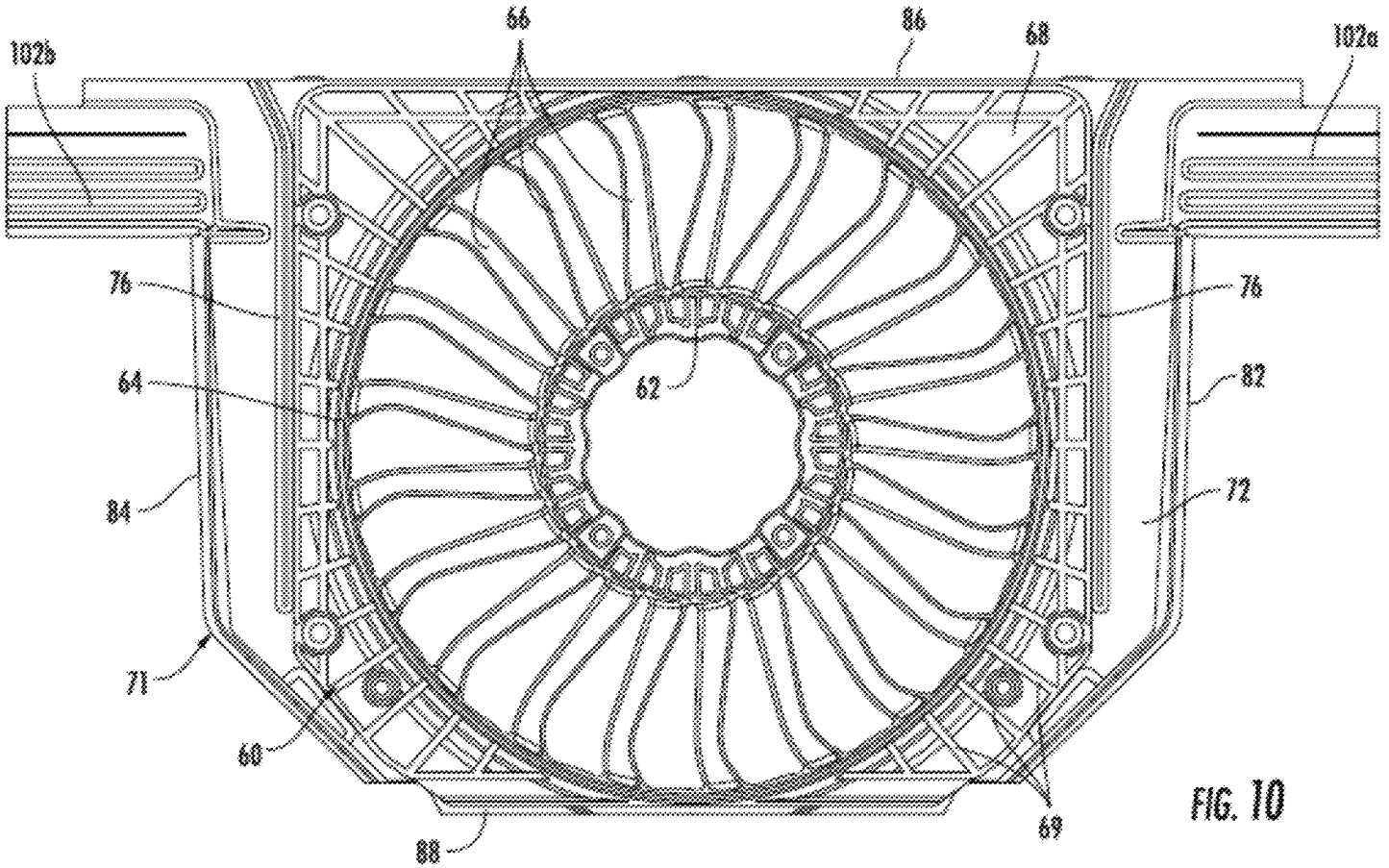
FIG. 10 is a top view of an exemplary stator assembly mounted to a mounting bracket according to an embodiment.
Figure 11:
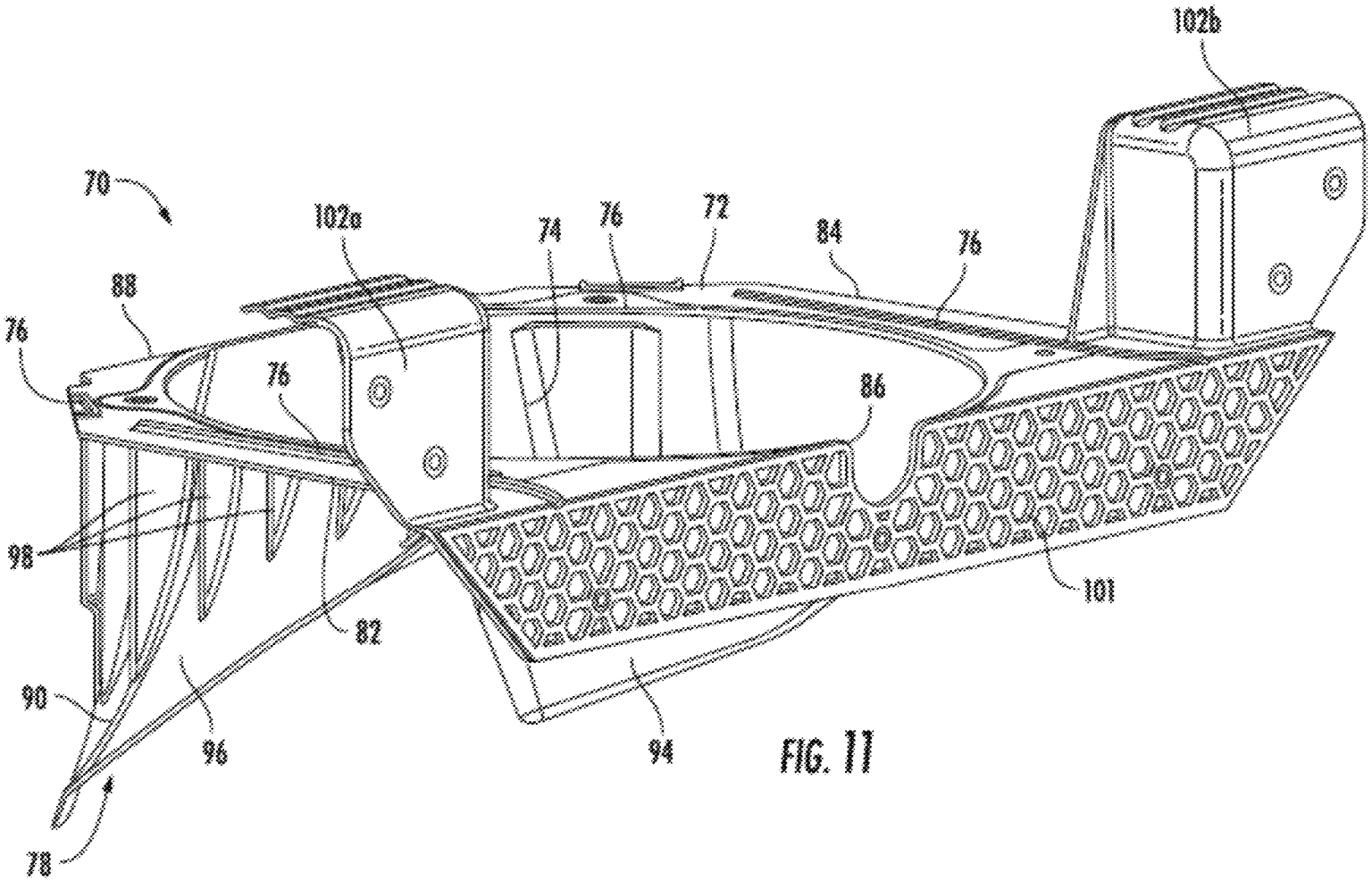
FIG. 11 is a perspective view of an exemplary mounting bracket according to an embodiment.
Figure 12:
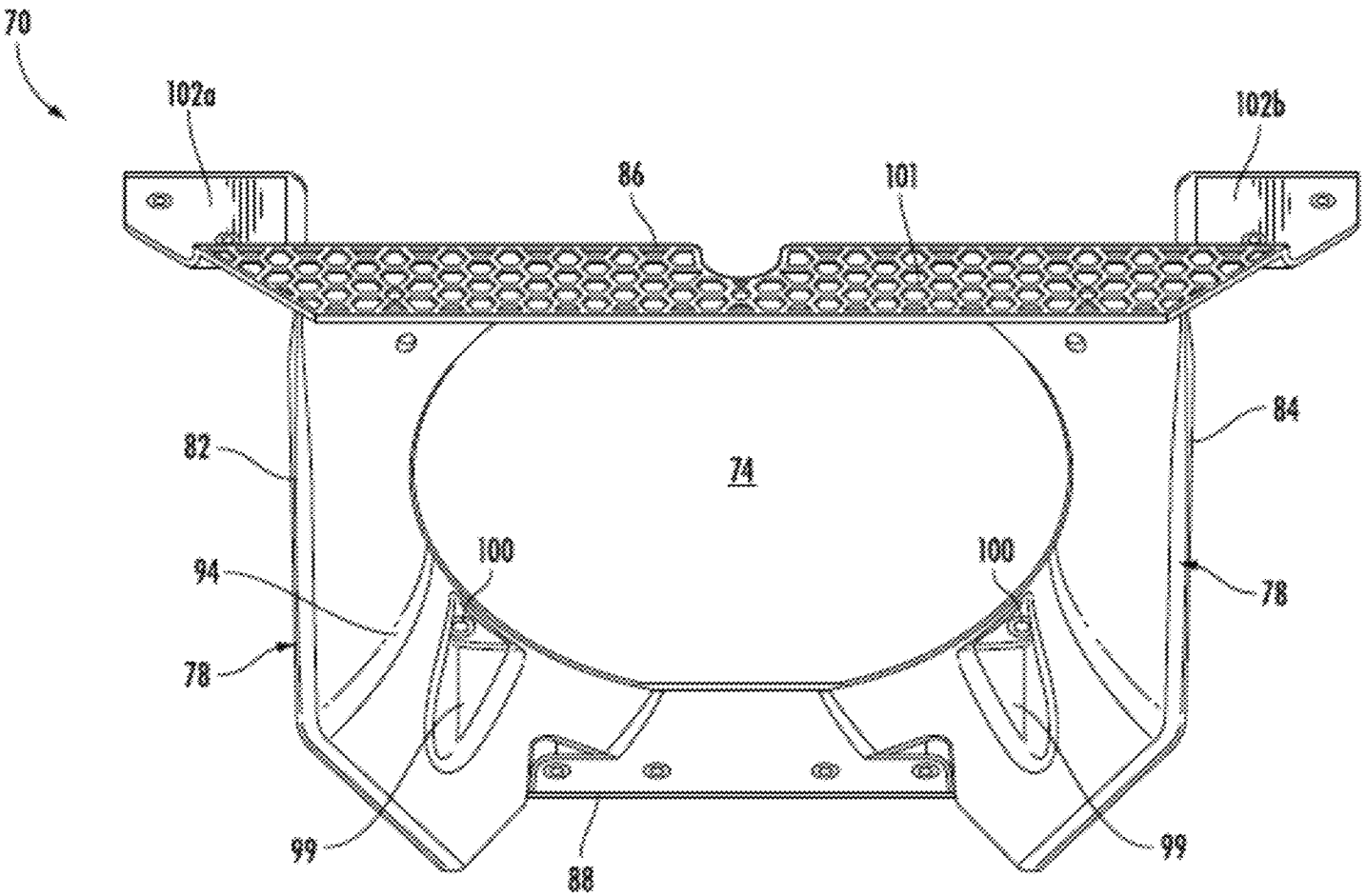
FIG. 12 is a bottom perspective view of the exemplary mounting bracket of FIG. 11 according to an embodiment.
Figure 13:
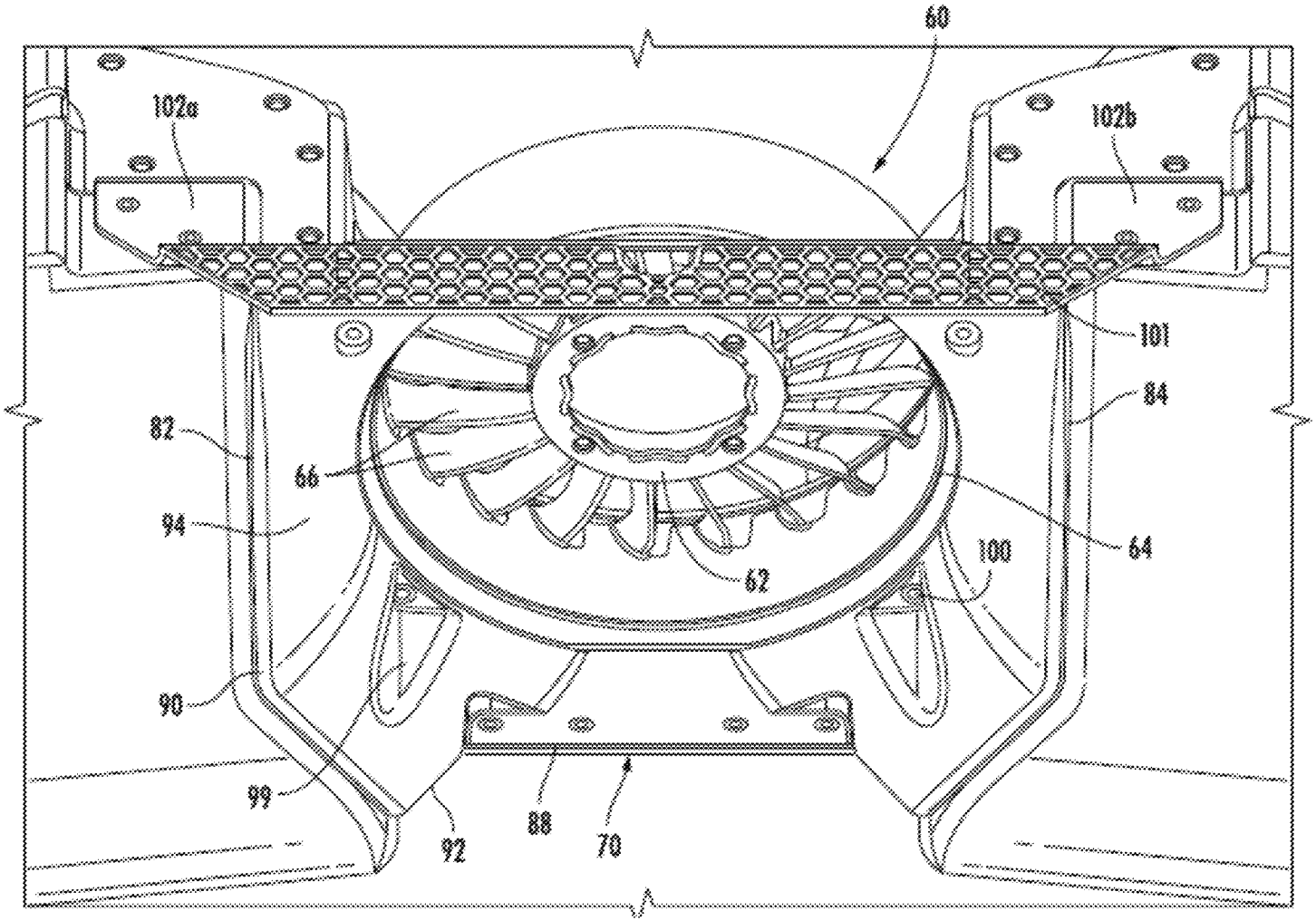
FIG. 13 is a bottom perspective view of an exemplary mounting bracket installed within an interior region of a fan and nozzle unit according to an embodiment.
Figure 14:
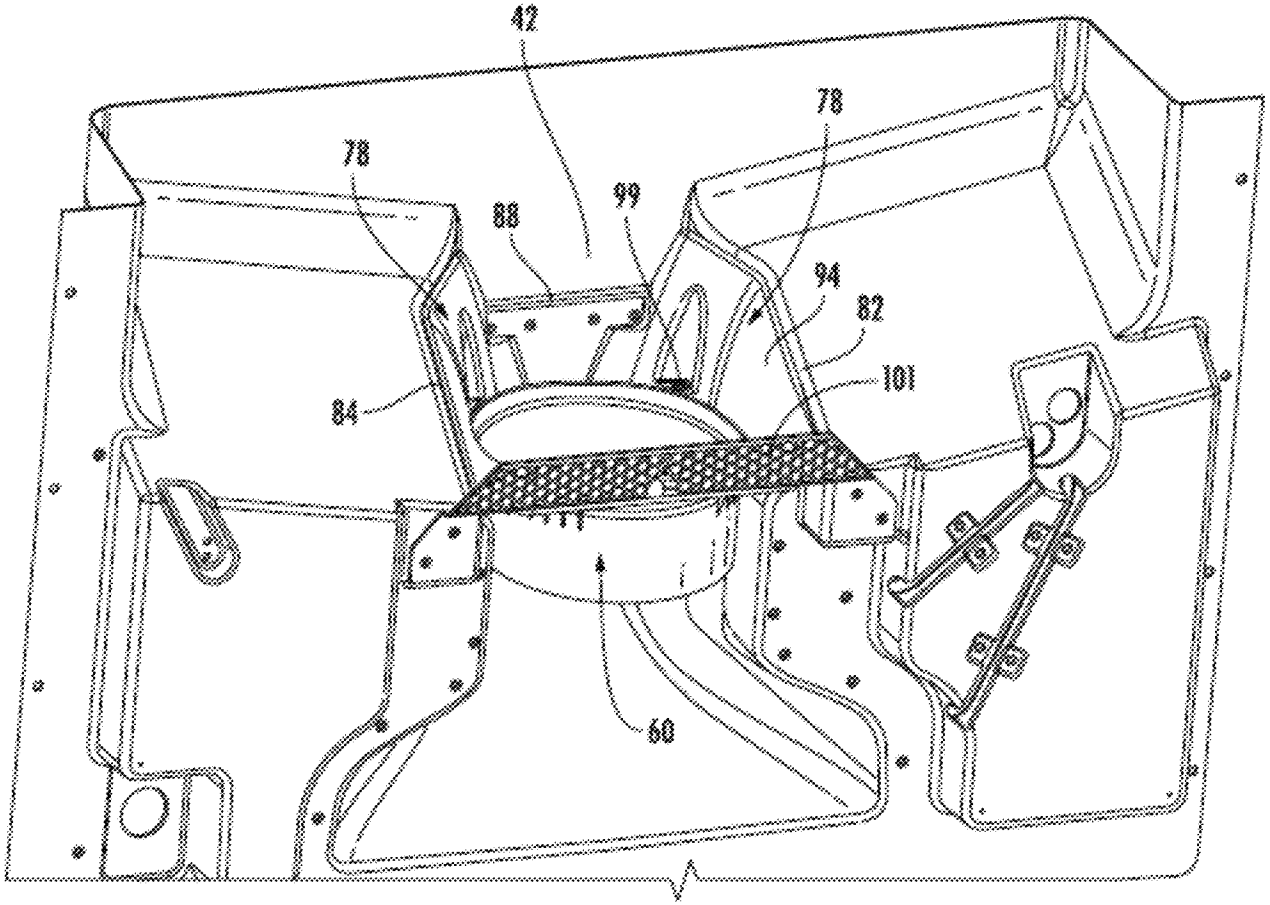
FIG. 14 is another bottom perspective view of an exemplary mounting bracket installed within an interior region of a fan and nozzle unit according to an embodiment.

As shown in FIG. 9, the front wall 101 may include a cutout 103, such as extending downwardly from the planar first surface 72, to facilitate installation of the fan 44. Although a u-shaped cutout is illustrated in the FIG., it should be understood that a cutout having another shape is also within the scope of the disclosure. However, embodiments of the of the mounting bracket 70 where the front wall 101 does not include a cutout are also contemplated herein.

The mounting bracket 70 may additionally include one or more mounting members positionable in overlapping arrangement with a surface of the fan and nozzle unit 40. The mounting members may be integrally formed with the body, or alternatively, may be a separate component connected to the main support member 71. In the illustrated, non-limiting embodiment, a first mounting member 102*a* extends from the first surface 72, near the front end 86 and the first side 82 of the main support member 71. Alternatively, or in addition, a second mounting member 102*b* extends from the first surface 72, near the front end 86 and the second side 84 of the main support member 71. As shown, each mounting member 102*a*, 102*b* has three surfaces extending generally perpendicular to one another to form a corner-like configuration. In such embodiments each mounting member 102*a*, 102*b* is positioned over a corresponding corner formed in the fan and nozzle unit 40. However, it should be understood that a mounting member 102*a*, 102*b* having another suitable configuration that overlaps one or more surfaces of the fan and nozzle unit 40 are also contemplated herein. The at least one mounting member 102*a*, 102*b* may be attached to the fan and nozzle unit 40 via one or more fasteners 104, such as screws or bolts for example.

The axial fan 44 is supported by the stator assembly 60 mounted to the first surface 72 of the mounting bracket 70. Accordingly, the position of the axial fan 44 may be dependent on the height of the mounting members 102*a*, 102*b* relative to the first surface 72 of the mounting bracket 70. Accordingly, the height of the mounting members 102*a*, 102*b* may be adjusted to position the axial fan 44 at a specific distance from the plenum or from the heat exchanger coil 38. In an embodiment, the axial distance between the top of the mounting members 102*a*, 102*b* and the first surface 72 is between about 80 mm and about 150 mm.

A mounting bracket 70 as illustrated and described herein enhances the air flow towards the fan, without requiring any changes to the existing contour of the fan and nozzle unit 40. Further, although the mounting bracket 70 is illustrated and described herein with respect to an evaporator coil, it should be appreciated that the mounting bracket may be adapted for use with any heat exchanger, such as condenser 32 for example.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A transport refrigeration unit comprising:

a fan and nozzle unit having a unit body including at least one interior region;

a heat exchanger coil;

an axial fan having a vertically oriented fan axis, the axial fan being positioned within the at least one interior region of the unit body to draw air through the heat exchanger coil and discharge the air vertically upwards; and a mounting bracket for mounting the axial fan in the fan and nozzle unit comprising:

a main support member having a body including a front end, a back end, a planar first surface, an opposite and second surface, and a through hole extending between the first surface and the second surface; and at least one sidewall integrally formed with and extending from the second surface between the front end and the back end, wherein an axial length of the at least one sidewall at the back end measured parallel to the fan axis is greater than the axial length of the at least one sidewall at the front end and the at least one sidewall has a curved front surface to facilitate flow towards a fan inlet.

2. The transport refrigeration unit of claim 1, wherein a diameter defined by the at least one sidewall gradually increases from adjacent the body of the main support member to a distal end of the at least one sidewall.

3. The transport refrigeration unit of claim 1, wherein the at least one sidewall has a back surface opposite the front surface, the back surface having a configuration complementary to a surface of the unit body.

4. The transport refrigeration unit of claim 3, further comprising at least one feature arranged at the back surface, wherein the at least one feature extends between the back surface and the body of the main support member.

5. The transport refrigeration unit of claim 1, wherein the at least one sidewall has a bend formed therein such that the at least one sidewall wraps about the back end of the main support member.

6. The transport refrigeration unit of claim 1, wherein the at least one sidewall includes a first sidewall and a second sidewall, the first sidewall and the second sidewall being symmetrical about a central plane.

7. The transport refrigeration unit of claim 1, wherein the body of the main support member has a front end and a back end, the mounting bracket further comprising a front wall extending from the front end at an angle thereto.

8. The transport refrigeration unit of claim 7, wherein the front wall is arranged perpendicular to the first surface of the body of the main support member.

9. The transport refrigeration unit of claim 8, wherein the front wall further comprises a honeycomb-like pattern is formed at a surface thereof.

10. The transport refrigeration unit of claim 1, further comprising at least one feature protruding from the first surface of the body of the main support member, wherein the at least one feature defines at least a portion of a boundary within which the axial fan is positionable.

11. The transport refrigeration unit of claim 1, further comprising at least one mounting member extending from the first surface of the body of the main support member, the at least one mounting member having a body positionable in overlapping arrangement with a surface of the fan and nozzle unit.

12. The transport refrigeration unit of claim 11, wherein the body of the at least one mounting member has a corner-like configuration.

13. The transport refrigeration unit of claim 1, wherein the mounting bracket is formed from a glass filled composite material.

14. A transport refrigeration unit comprising:

a fan and nozzle unit having a unit body including at least one interior region;

a heat exchanger coil;

an axial fan having a vertically oriented fan axis, the axial fan being positioned within the at least one interior region of the unit body to draw air through the heat exchanger coil and discharge the air vertically upwards, the axial fan comprising a stator assembly including a mounting flange arranged at a first end thereof; and a mounting bracket formed from a composite material, the mounting bracket including:

a main support member having a body including a planar first surface, an opposing second surface, and a through hole extending between the first surface and the second surface, wherein the mounting flange is positionable in overlapping arrangement with the first surface; and at least one sidewall integrally formed with and extending from the second surface, the at least one sidewall having a front surface, wherein a curvature of the front surface facilitates flow towards the stator assembly.

15. The transport refrigeration unit of claim 14, wherein the first surface further comprises at least one feature defining a boundary within which the mounting flange is positioned.

16. The transport refrigeration unit of claim 14, wherein a diameter defined by the at least one sidewall gradually increases from adjacent the body of the main support member to a distal end of the at least one sidewall.

17. The transport refrigeration unit of claim 14, wherein the at least one sidewall has a back surface opposite the front surface, the back surface having a configuration complementary to a surface of the at least one interior region of the unit body.

* * * * *